US005567482A

United States Patent [19]

Ilgar et al.

[11] Patent Number: 5,567,482

[45] Date of Patent: Oct. 22, 1996

[54] METHOD OF PROTECTING STEEL STRIP

[75] Inventors: Ersan Ilgar; Edward J. Patula, both of Monroeville, Pa.; James R. Roney, Canton, Mich.

[73] Assignees: USX Corporation, Pittsburgh, Pa.; Rouge Steel Company, Dearborn, Mich.

[21] Appl. No.: 575,816

[22] Filed: Dec. 20, 1995

[51] Int. Cl.[6] ..... C08J 7/04

[52] U.S. Cl. ..... 427/510; 204/192.1; 427/156; 427/178; 427/289; 427/295; 427/327; 427/328; 427/385.5; 427/406; 427/409; 427/553; 427/558; 427/559

[58] Field of Search ..... 204/192.1; 427/510, 427/558, 559, 385.5, 156, 178, 289, 295, 327, 328, 406, 409, 553

[56] References Cited

U.S. PATENT DOCUMENTS

| | | | |
|---|---|---|---|
| 2,516,986 | 6/1945 | Heinse | 41/18 |
| 2,999,771 | 9/1961 | Gaynes | 117/132 |
| 3,390,060 | 6/1968 | Bedi | 204/15 |
| 3,451,902 | 6/1969 | Levinos | 204/15 |
| 3,850,770 | 11/1974 | Juna et al. | 204/159.19 |
| 4,224,118 | 9/1980 | Hans | 204/15 |
| 4,270,985 | 6/1981 | Lipson et al. | 204/15 |
| 4,379,039 | 4/1983 | Fujimoto et al. | 204/159 |
| 4,399,239 | 8/1983 | Herwig et al. | 521/137 |
| 4,587,136 | 5/1986 | White et al. | 427/54.1 |
| 4,710,638 | 12/1987 | Wood | 250/492.1 |
| 4,761,363 | 8/1988 | Hung et al. | 430/284 |
| 4,784,740 | 11/1988 | Murakami et al. | 204/206 |
| 4,969,980 | 11/1990 | Yoshioka et al. | 204/28 |
| 5,078,080 | 1/1992 | Schiele | 118/50 |
| 5,258,225 | 11/1993 | Katsamberis | 428/331 |
| 5,260,350 | 11/1993 | Wright | 522/42 |
| 5,298,072 | 3/1994 | Schiele et al. | 118/681 |

FOREIGN PATENT DOCUMENTS 158386 11/1992 Japan .

*Primary Examiner*—Bernard Pianalto
*Attorney, Agent, or Firm*—William L. Krayer

[57] ABSTRACT

In a high-speed electrogalvanizing process, steel strip is protected from the formation of troublesome zinc nodules by masking the edges of the strip, while the strip is moving and upstream from the electrogalvanizing step, with an ultraviolet curable coating, and curing the coating, while the strip is moving, prior to introduction to the electrogalvanizing step.

19 Claims, 3 Drawing Sheets

METHOD OF PROTECTING STEEL STRIP

TECHNICAL FIELD

This invention relates to electrogalvanizing and particularly to the protection of steel strip from the formation of small zinc nodules on or near the edge of the steel strip during the high-speed electrogalvanizing process. The formation of such nodules is reduced or minimized through the application to the edge of the strip of a masking coating which exhibits a very fast cure under ultraviolet radiation. The coating is applied and cured while the strip is moving, preferably immediately upstream of the electrogalvanizing step.

BACKGROUND OF THE INVENTION

The present invention is directed to difficulties in electrogalvanizing incident to overdeposition of zinc. Overdeposition is a function of the electrical characteristics of the process, specifically high current density burning. The particular variety of overdeposition to which our invention is addressed is the formation of zinc nodules, sometimes referred to as "cabbage heads" which not only are undesirable in place, but tend to become loose and may result in highly undesirable marring of the main portion of the strip and/or the finished product, such as the product of a metal stamping process. They may cause dents, dimples, and high spots on the strip. The problems of zinc pickup and the formation of cabbage heads are more pronounced where higher zinc coating weights are deposited. The cabbage heads are generally formed at the extreme edge of the strip and on the edge wall, which tend to collect high zinc coating weights.

Finding solutions for the problem is made difficult by the high production rates of typical electrogalvanizing lines. It is not uncommon for low-carbon steel strip to travel at rates of the order of 1000 feet per minute (305 meters per minute) through a series of rolls prior to entering the electrogalvanizing zone. A demanding aspect of the problem is therefore that, if an edge masking material is applied in liquid form it should be fully cured in a very few seconds (2 or 3), preferably less than one second. Other desiderata for the coating, depending on the conditions of the plating process, are that it should be tough enough to withstand mechanical abrasion from traveling at high speed through rubber and metal rolls, it should not conduct electricity, and it should be environmentally acceptable and nontoxic for ease in handling before and during use, and for disposal. In addition, the process of applying and curing the edge mask must be conveniently and continuously performed so as not to cause shutdowns or other complications. Different manufacturing facilities and processes will have different demands and specific needs, and the practitioner skilled in the art will keep them in mind when choosing a coating.

A 1968 patent to Bedi, U.S. Pat. No. 3,390,060, describes the use of two different types of waxes to protect metal during plating processes. The waxes were applied with solvents, however, which had to be dried off before the specimens could be used. Such a procedure would be wholly incompatible with a high-speed electrogalvanizing line, not only because the coating would not "set" in the very short time available for the steel strip, but also because the continuous release of solvents into the atmosphere could not be tolerated in a contemporary electrogalvanizing plant. See also Heinse U.S. Pat. No. 2,516,986, which masks stainless steel against copper plating with a wax, and Gaynes U.S. Pat. No. 2,999,771, which discusses an acid-resistant coating for use in chrome plating; the coating is a modified vinyl chloride polymer in a solvent.

Lipson et al, in U.S. Pat. No. 4,270,985, is representative of a number of disclosures of the use of radiation-curable resins as masking agents for making printed circuits, wherein the photopolymerizable resin is placed on a copper sheet or foil, for example, in the desired circuit pattern and the unprotected areas are etched away. Galvanizing may be viewed as the opposite of etching, in that metal is added to metal; the present invention is directed to a method of protecting an edge of steel strip from the deposition of zinc so as to avoid the formation of "cabbage heads"; this has nothing to do with etching away the unprotected areas of the substrate.

Levinos, in U.S. Pat. No. 3,390,061, is representative of disclosures of various solvent-based coatings used to protect areas of metal against plating by other metals, in this case to cover one side of an aluminum sheet being plated with copper. Such references merely demonstrate that coatings have been used to protect metals during plating processes. See, as an additional example, Hans' U.S. Pat. No. 4,224,118, which presents a particular resin for use as a masking agent. The present invention does not benefit from such teachings, however, because they do not deal with high speed steel strip and they generate solvent fumes. While Yoshioka et al, in U.S. Pat. No. 4,969,980, deal with high speed galvanizing, they use a protective coating for an entire surface of the strip simply to prevent the galvanizing process from plating on both sides. White et al in U.S. Pat. No. 4,587,136, describe a silicon-containing composition which is useful in our invention, saying that it could be applied to steel (col 6, line 2), but do not contemplate applicants' purpose and constraints.

The problem of edge overcoat, or excessive zinc on the edge of the finished product, is attacked by Tsuruta et al in Japanese laid-open patent 58-113396 (1983) by using one of a variety of mechanical edge masks or shields, which are shaped generally like a channel or longitudinally slit tube. In this representative patent, the edge of the strip is made to pass through the open area of the semicylindrical or U-shaped (profile) area of the edge mask or shield, thus intercepting and reducing the intensity of the electrical energy directed at the extreme edge of the strip. Such references serve to illustrate and emphasize the importance of the problem. This and other mechanical approaches are subject to many problems of maintenance and control. See, for example, U.S. Pat. No. 4,784,740 to Murakami et al, which illustrates a positioner for such mechanical devices. In Japanese patent 158386, a U-shaped profile shield is supplemented by the use of solvent-based paint on the vertical edge of the strip.

Japanese Kokai 6-158386 (1994) illustrates and describes the application of a conventional coating to the edges of steel strip in preparation for galvanizing. Its purpose is to prevent edge overcoating, but the procedure does not contemplate integration with the electrogalvanizing process, i.e. applying and curing the coating while the strip is moving at high speeds and about to enter the electrogalvanizing step.

The state of the edge-coating apparatus art is represented in Schiele's U.S. Pat. No. 5,298,072, which describes a vacuum-assisted system for moving liquid coating from a pool to the surface desired to be coated. Excess coating material is economically recirculated. The particular configuration of the edge-coating heads 3 can be changed to adapt to the requirements of various workpieces and continuous feeding mechanisms. See also Schiele's U.S. Pat. No. 5,070,080, which describes a continuous vacuum coating apparatus.

The use of ultraviolet radiation to cure efficiently liquid coatings containing photoinitiators is described by Wood in U.S. Pat. No. 4,710,638. This patent illustrates a reflector having an elliptical profile which directs the radiation from a tubular electrodeless ultraviolet source energized by microwave energy to an elongated workpiece. The principle of the elliptical reflector is that light emitted at one focus of a full ellipse will pass through the other focus. Wood's device helps assure that light emitted from a tubular source placed with its center at one of the foci of the ellipse will, as efficiently as practical, strike the workpiece occupying the other focus and its immediate surroundings.

SUMMARY OF THE INVENTION

We have found that the formation of unwanted zinc nodules on or near the edge of steel strip during the electrogalvanizing process can be prevented through the application of an ultraviolet-cured non-conductive coating applied in an edge band from one millimeter to seven millimeters wide, preferably about one-eighth inch wide, on the edges of the broad surface or surfaces to be electrogalvanized; the vertical edge is also protected with the non-conductive coating. Applying the coating only to one broad side of the strip, at its edge, will have a positive effect and this mode of operation may be used where only one side is to be plated (it may be used where both sides are to be plated also, but the unprotected side may still exhibit cabbage heads) or, it may be applied to both sides near the edge, or it may be applied to the vertical edge, by itself or with one or the other of the sides. The preferred mode is to apply the coating in narrow bands at the extremities of the top and bottom, and on the vertical edge, of the sheet, particularly where the electrogalvanizing is to be performed on both sides of the strip. We are able to apply the coating as a liquid and cure it by radiation in a very short time, typically less than a second, so that it will withstand the rigors of the electrogalvanizing process, which it can then enter immediately. The edge-banding process is integrated into a high-speed continual electrogalvanizing line.

BRIEF DESCRIPTION OF THE DRAWINGS

FIG. 2*a* is a simplified side elevational view of the head; FIG. 2*b* is a perspective view with the strip in place for application of the coating.

DETAILED DESCRIPTION OF THE INVENTION

Figure 1:
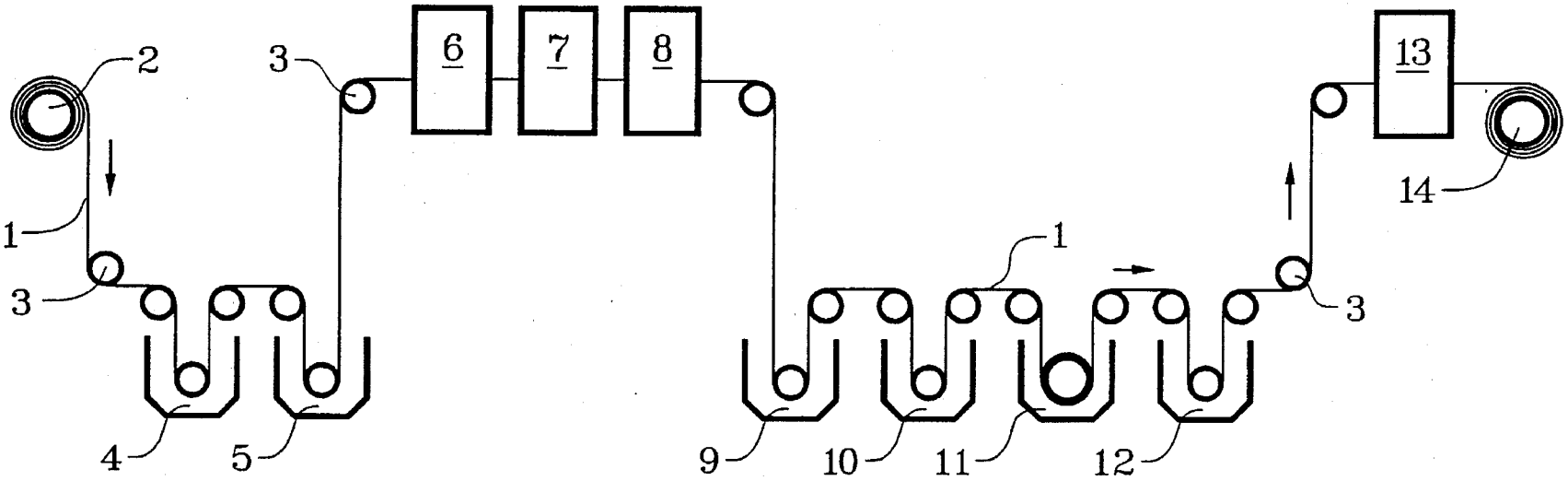
FIG. 1 is a simplified flow sheet showing the integration of our edge-banding process in a more or less conventional high-speed electrogalvanizing line.

Any coating which can be applied in liquid form as a thin band to the edge of a steel strip at speeds of one hundred to twelve hundred feet per minute and cured to an adherent, non-conductive solid within a few seconds, preferably less than one second, by ultraviolet radiation is contemplated in our invention. The thin band may be applied to one or both sides of the strip with or without the inclusion of the vertical edge as a recipient of coating.

Suitable compositions for such coatings are well known, and may be said generally to contain (a) at least one reactive oligomer or prepolymer, (b) at least one monofunctional monomer, (c) optionally, at least one multifunctional monomer selected to crosslink with the oligomer and (d) at least one ultraviolet photoinitiator. Our invention contemplates the use of any of such coating compositions which are substantially free of pigments and fillers opaque to ultraviolet radiation, and substantially free of non-reactive solvents.

Pigments, fillers and other minerals or solids which are opaque to ultraviolet radiation can be tolerated in very small amounts, but are not recommended as they will, generally speaking, increase the amount of radiation required for the cure of a given amount of coating and, if too much is present, make it difficult or impossible to assure that a complete cure will be effected before the strip enters the electrogalvanizing zone. If the coating enters the electrogalvanizing bath in an uncured state, it can easily come off the strip and will soon foul the process.

The coating composition should also be substantially free of non-reactive solvents for safety reasons in the workplace, i.e. many solvents are volatile, combustible and even explosive under conditions not uncommon in a steel mill; also because of the venting and/or solvent adsorption requirements and/or environmental problems presented by the continuous evaporation of solvents, as well as the sheer waste implied by not using a portion of the coating composition. While a small amount of non-reactive, volatile, solvent can be tolerated in the coating formulation so long as its presence does not unduly delay the curing step, only compositions substantially free of such solvent are contemplated in our process.

It will be noted in the discussion below that we do not eschew the action or function of solvents in the coating formulations, particularly to adjust viscosity; rather, we choose monofunctional polymerizable (reactive) monomers which can perform that function.

The ingredients of suitable coating formulations are described below.

(a). The reactive oligomer or prepolymer. Probably the most common type of reactive group used in ultraviolet radiation cured coatings is the acrylic group. The acrylic moiety has been attached to epoxies, polyesters, polyethers, urethanes, silicones, polybutadiene, and other acrylics. Typical acrylic monomers used to produce reactive oligomers or prepolymers are acrylic acid, hydroxy ethyl acrylate, acrylamide, and glycidyl acrylate. Typical prepolymers or oligomers are epoxy acrylates, urethane acrylates, and polyester acrylates. A simple example is the reaction product of two moles of hydroxy ethyl acrylate with one mole of a di-isocyanate, such as toluene diisocyanate. The reactive oligomers and prepolymers made by such reactions containing two or more reactive ethylenically unsaturated groups are excellent for our purposes for two basic reasons—they are large molecules already occupying a certain volume of the space to be coated, and they have two or more, preferably several, reactive groups which will crosslink and therefore cure quickly to a solid.

An excellent description of acrylated urethanes which may be used in our invention is to be found in Katsamberis U.S. Pat. No. 5,258,225—see column 7, line 3 to column 8, line 19. This patent is incorporated herein by reference. We particularly prefer the alkyl acrylated urethanes described in the Katsamberis patent, such as methacrylated urethanes, for our reactive oligomer or prepolymer. The unsaturated polyurethanes proposed for radiation polymerization by Herwig et al in U.S. Pat. No. 4,399,239 are also suitable—this patent is also incorporated by reference in its entirety. See also the list of photopolymerizable compounds having two or more double bonds in Fujimoto et al U.S. Pat. No. 4,379,039, column 4, line 40 to column 5, line 18.

(b) The monofunctional monomer. The most common monofunctional monomer is styrene. While styrene is relatively volatile, its emission is controlled by the extremely fast reaction rate provided by the photoinitiation process and the tendency of the crosslinking compounds to create physical barriers to the passage of the styrene monomer into the atmosphere before it is polymerized itself. Other suitable monofunctional monomers include α-methyl styrene, chlorostyrene, alkyl acrylates and methacrylates, polyalkylene glycol mono(meth)alkylates, and substituted alkyl mono(meth)acrylates. Any photopolymerizable mono-unstaurated compound is contemplated. Styrene and most other reactive monomers will act at least to some extent as a solvent or diluent, and we utilize this property as a means for controlling viscosity, but, as mentioned above, we generally avoid organic non-reactive solvents because they are unnecessarily released into the atmosphere to at least some extent. Hung et al, in U.S. Pat. No. 4,761,363, provide a list of "reactive diluent monomers" suitable for use in our invention, at column 7, lines 5–55, which is hereby incorporated by reference.

(c) The optional multifunctional monomer. Common di- and polyfunctional monomers, or crosslinkers, are tripropylene glycol diacrylate, hexane diol diacrylate, diethylene glycol diacrylate, tetra ethylene glycol diacrylate and compounds of the general formula $$(H_2C{=}\underset{\underset{R^1}{|}}{C}{-}\overset{\overset{O}{||}}{C}{-}O)_n{-}R$$

where n is an integer from 1 to 4, preferably 2 or 3, and R is selected from the group consisting of n functional hydrocarbon residues and n functional substituted hydrocarbon residues, and $R^1$ is hydrogen or a lower alkyl radical such as methyl, generally as described by Katsamberis in U.S. Pat. No. 5,258,225, column 3, line 65 to column 5, line 3; this patent is already incorporated herein by reference. Suitable diacrylates include 1,6-hexanediol diacrylate, 1,4-butanediol diacrylate, ethylene glycol diacrylate, neopentylglycol diacrylate, 1,4-butanediol dimethacrylate, pentaerythritol tetraalkylate, trimethylolpropane diacrylate, bisphenol-A dimethacrylate, and polyethylene glycol dimethacrylate. Suitable polyfunctional monomers include trimethanolpropane triacrylate, glycerol propoxy triacrylate, and trimethylol propane ethoxy triacrylate.

The optional multifunctional monomer is said to be optional because coatings consisting substantially only of components (a), (b), and (d) as recited above will perform quite well in our invention. Many commonly commercially available UV-curable coating compositions, however, contain materials intermediate in molecular weight, and, to an extent, number of polymerizable groups, between the oligomer/prepolymers of component (a) and the monofunctional reactive monomers of component (b), although there is no distinct clear molecular weight line to be drawn. Such intermediate compounds as are listed in the paragraph next above are well known to be readily polymerizable and very efficient at crosslinking, which is desirable in our process.

(d) The photoinitiator(s). Suitable photoinitiators include the ketone-type photoinitiators such as benzophenone and other acetophenones, benzil, benzaldehyde and o-chlorobenzaldehyde, xanthone, thioxanthone, 2-chlorothioxanthone, 9,10-phenanthrenequinone, methylbenzoin ether, ethylbenzoin ether, diethoxy phenyl acetophenone, isopropyl benzoin ether, a,a-dimethoxyacetophenone, 1-phenyl-1,2-propanediol-2-o-benzoyl oxime, 2-ethylanthraquinone, 2-t-butylanthraquinone, octamethylanthraquinone, α-phenyl benzoin, and a,a-dimethoxy-a-phenylacetophenone. Commercially available photoinitiators particularly recommended for ultraviolet curing include 2-hydroxy-2-methyl-1-phenyl-propane-1-one ("Darocure 1173" sold by EM Chemicals of Hawthorne N.Y.) and 2,2-dimethoxy-2-phenylaceto-phenone, or "Irgacure 651" sold by Ciba-Geigy. See Wright U.S. Pat. No. 5,260,350 at col 6, lines 10–29. Also useful herein are aromatic sulfonyl chlorides such as 1-naphthalene sulfonyl chloride and 2-naphthalene sulfonyl chloride, and various bicarbonyl compounds see Juna U.S. Pat. No. 3,850,770 col 4, lines 60–65. The list of photoinitiators in column 6, lines 3–63 of Fujimoto U.S. Pat. No. 4,379,039 is suitable for use herein and is incorporated herein by reference.

The photoinitiator may be used in conventional amounts, i.e. between 0.1 to 5 percent by weight of the coating composition.

Suitable coatings which do not include optional component (c) should comprise about 30–90% by weight component (a), about 10–70% by weight component (b), and about 0.05 to 5% by weight photoinitiator. Component (c) may be added to such a formulation in amounts up to about 75 parts by weight per 100 parts by weight of the balance of the composition. Expressed another way, the weight ratio of component (a) to component (b) is desirably about 0.4:1 to about 9:1. Other suitable coatings include any coating which will cure to a non conductive solid in less than ten seconds under ultraviolet radiation.

Any method of applying the paint or other coating to the edge (on the broad surface) of a steel strip while it is traveling at speeds of one hundred to twelve hundred feet per second is included within the scope of our invention. Such methods include rollers, sprays, jets, and edge immersion. We prefer a pneumatic or vacuum applicator as is described in FIG. 2, more or less enveloping the surface to be coated, to minimize overspray, and prefer to include devices for recapturing and recycling droplets which may otherwise escape to the atmosphere; the preferred industrial installation will also have a vacuum or vent to collect and/or dispose of whatever volatile components of the liquid coating may be emitted into the atmosphere.

After curing, most of the coatings described are substantially transparent and can be difficult to see. For this reason, it may be desired to incorporate a small amount of one or more organic components which will be visible, such as fluorescent dyes. Such dyes are generally not volatile and will not otherwise defeat the main purpose of applying a non-conductive coating to the edge of the strip.

A preferred sequence of treatment of strip for galvanizing is depicted in FIG. 1. In FIG. 1, steel strip 1 from a coil 2 is fed through a series of rolls 3 through a caustic cleaning tank 4, and a rinse tank 5 to a drying section 6, an edge coating section 7, to be illustrated in FIG. 2, and an ultraviolet radiation or curing section 8, then to a pickling tank 9, rinse tank 10, electrogalvanizing section 11, rinse tank 12, side trimming zone 13, and on to collector coil 14.

The caustic cleaning and rinse tanks 4 and 5 may be of any conventional types, and in fact the cleaning section may vary considerably with the particular steel coil which is to be galvanized. Generally, the strip should be clean for good results, as is known in the art of electrogalvanizing. In addition, for our invention, it is desirable to remove residual carbon and iron from the strip surface, as these are electroconductive and, if present in sufficient quantity, can defeat the purpose of the edge coating, which is to insulate the edge of the strip from the electrical forces in the electrogalvanizing zone 11. Any effective manner of cleaning is acceptable in our invention; of course if the strip is already clean, the cleaning section need not be employed. Likewise any effective manner of drying may be employed in drying section 6. The strip, or at least the edges to be coated, should be reasonably dry before the strip enters the coating section 7. Coating section 7 and UV radiation (curing) section 8 will be further illustrated and described in FIGS. 2 and 3.

Figure 2A:
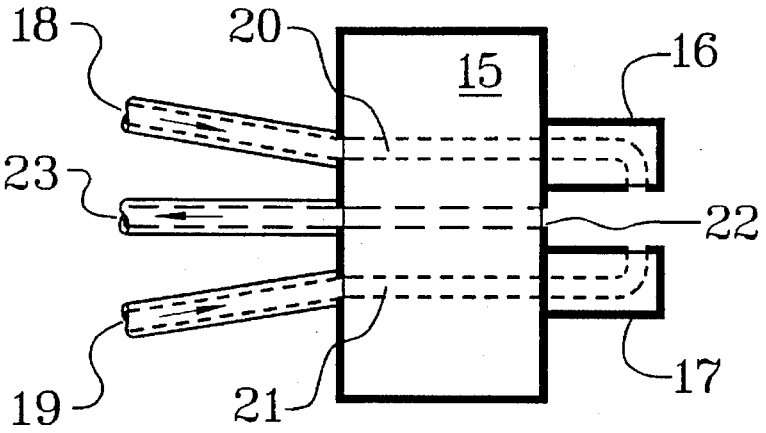
FIGS. 2*a* and 2*b* illustrate a preferred pneumatic or vacuum coating application head for applying the coating to the edge of the moving strip.

In FIG. 2*a*, a coating applicator head 15 for use in the coating section 7 is seen to have upper and lower coating nozzles 16 and 17 which deliver coating from hoses 18 and 19 and ducts 20 and 21. The applicator head 15 also has a vacuum aperture 22 which is connected through hose 23 to a source of vacuum not shown. The vacuum draws the liquid coating material from a source not shown through hoses 18 and 19 into application zone 24 where it may impinge on the strip 1; the vacuum being applied through aperture 22 and hose 23 minimizes overflow and/or excessive use of the coating, and may be used to recycle the coating material. Optionally also, atomization of the coating material may be assured by air turbulence, fogging heads, and the like. A preferred edge coater utilizing a head similar to that of FIG. 2 is described by Schiele in U.S. Pat. No. 5,298,072, which is incorporated herein by reference in its entirety.

Figure 2B:
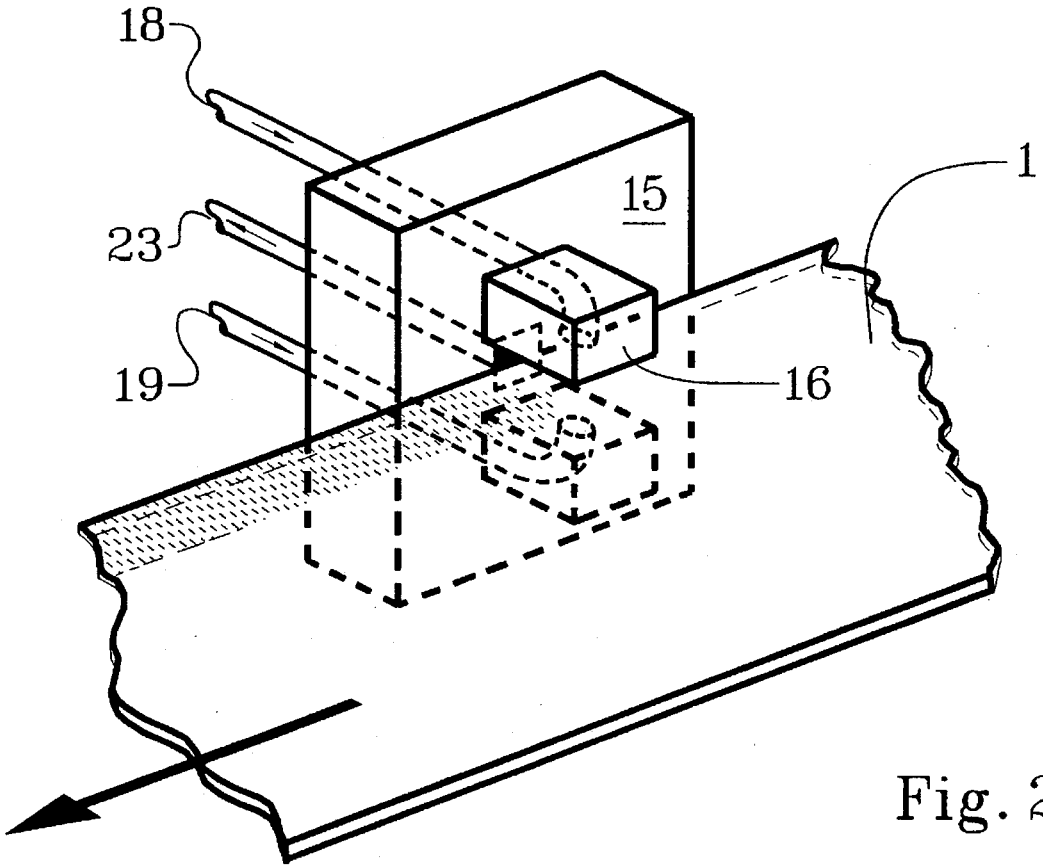

FIG. 2*b* shows strip 1 in place for coating in applicator head 15. As indicated elsewhere herein, the strip 1 may travel from 100 to 1200 feet per minute or more; normally the volume of coating placed on the strip 1 will be readily handled by the edge coater of the above referenced Schiele U.S. Pat. No. 5,298,072. The reader will appreciate that if vacuum is drawn on only one of the hoses 18 or 19, coating will be applied only on the corresponding surface of the strip; the vertical edge will also be covered, although not as thickly as if coating were coming from both nozzles 16 and 17.

Figure 3:
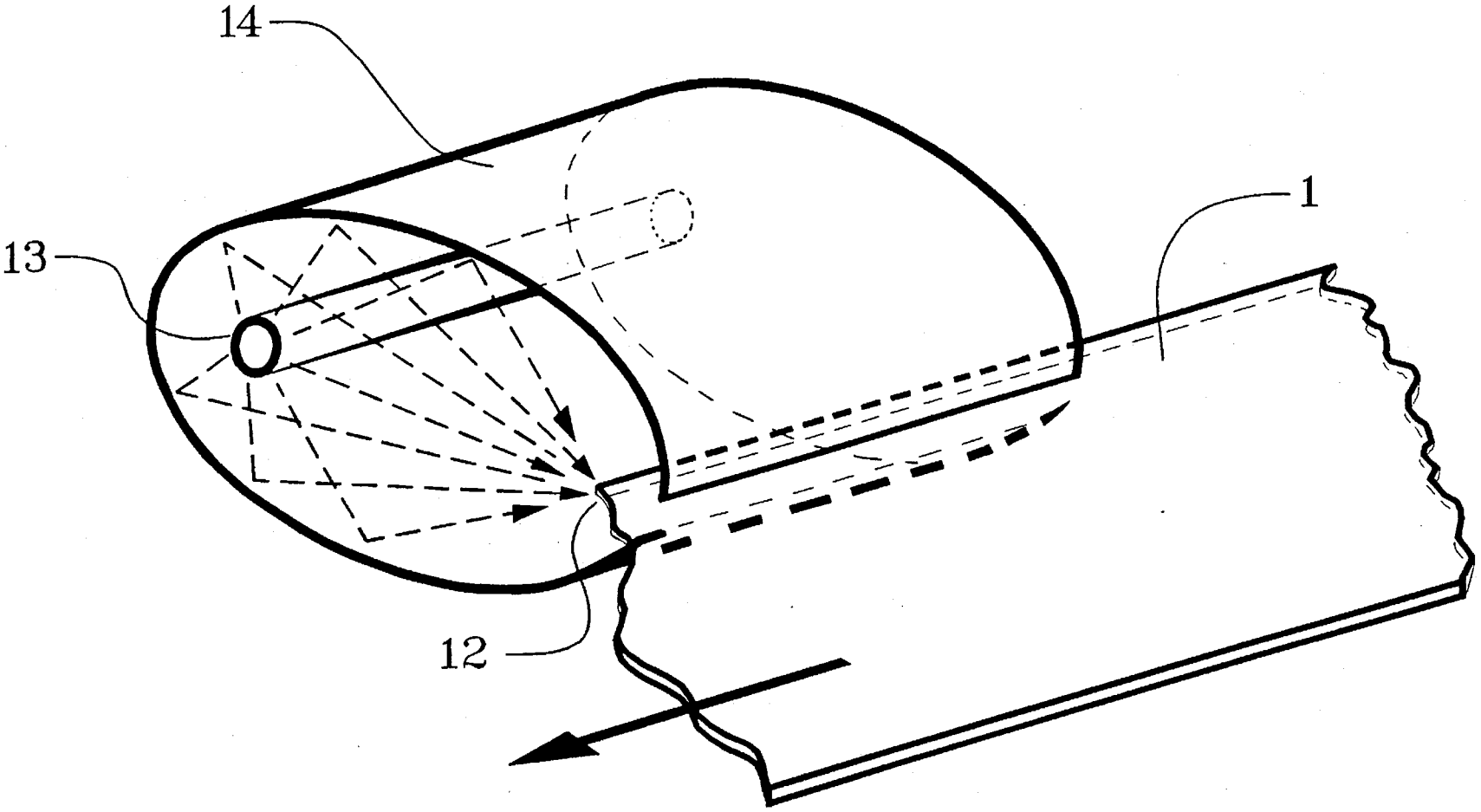
FIG. 3 is a more or less diagrammatic illustration of the placement and operation of the ultraviolet lamps used to cure the coating after its application to the edge of the sheet. This operation also takes place while the strip is moving at high speed.

It is to be understood also that one or more coating and curing devices such as shown in FIGS. 2 and 3 may be placed on opposite sides of the strip to coat and cure both continuous edges of the strip.

FIG. 3 depicts part of curing section 8 and illustrates a preferred manner of applying ultraviolet radiation to the coating on the edge of the strip. As seen in FIG. 3, steel strip 1 coming from the edge coating section 7 passes through an opening in reflector 14 and becomes exposed to ultraviolet radiation emanating from UV radiation source 13, typically a quartz bulb of a type well known in the art. Reflector 14 has an elliptical profile so that the radiation is reflected to a point occupied by the coated edge 12 of strip 1 as it passes through the reflector 14. Such a reflector is illustrated by Wood in U.S. Pat. No. 4,710,638, which explains how the elliptical profile shape utilizes the fact that very little of the radiant energy in fact originates in the exact focus of the ellipse; nevertheless it is applied efficiently because the workpiece also occupies space other than the exact focus on the other side of the ellipse. The above referenced Wood patent is incorporated herein by reference in its entirety as describing in detail a preferred method and apparatus for curing the coating similar to that of FIG. 3.

The coating may be conveniently confined to the desired band width by adjusting the vacuum and/or the size and orientation of the apertures in coating nozzles 16 and 17, as well as by adjusting the depth of insertion of sheet 1 into the space between nozzles 16 and 17. In other systems, it may be adjusted by the span of the spray or jet, or the width of the roller or other applicator, and may be applied to both sides and the vertical edge either simultaneously or sequentially. It is not necessary to obtain a cured thickness greater than one mil; generally, thicknesses greater than 0.002 inch will tend to be wasteful of coating material. Regardless of the composition of the coating, its cured thickness should be at least 0.25 mil, i.e. about 0.00025 inch.

The amount of radiation to be applied to a given point on the coating band will vary with the monomer and polymer content, the efficiency of the photoinitiators in the particular coating composition, and the thickness of the coating applied. The manner of applying the radiation should also be chosen with the speed of the strip in mind—that is, if a full cure of a given composition of a given thickness requires radiation of a given strength for 0.5 second, and the strip is traveling at 500 feet per minute, it will be recognized that the strip bearing the edge band to be cured must be exposed to that intensity of radiation for a distance of 50 inches, the distance it travels in 0.5 second. If the strip is moving at 1000 feet per minute, radiation at the given strength would need to be applied for a distance of 100 inches. The application of radiation of a given intensity is in turn a function of both the strength of the source and, in many cases, its distance from the edge band. The effect of distance is greatly influenced by the use of reflectors such as the elliptical reflector illustrated in FIG. 3.

Two or three or more of the ultraviolet lamp and reflector combinations such as shown in FIG. 3 may be used serially, and may be required where very high speeds are used. Commercially available quartz ultraviolet lamps of 600 Watts per inch and eight inches long can be used in reflectors such as reflector 14. Three such lamps placed serially will normally be adequate for the fastest contemporary electrogalvanizing lines.

The term "electrogalvanizing" is defined as coating with zinc with the use of an electric current. It is well known, however, that the zinc may have included in it minor amounts of other metals such as lead, antimony, and particularly nickel or iron. Some zinc/nickel and zinc/iron compositions may be referred to as alloys. Our invention includes processes which deposit such coatings in the electrogalvanizing step. Thus when we use the term "electrogalvanizing" we intend to include processes which deposit any coating containing a significant amount of zinc, i.e. at least 50% zinc.

After the electrogalvanizing step, the edge band may be trimmed from the galvanized strip in a conventional manner before re-coiling.

The invention will be further described with respect to the following demonstration:

EXAMPLE I

One-eighth inch bands of various UV-curable coatings were placed on the edges of steel strip samples, cured with ultraviolet radiation, and subjected to conditions simulating an electrogalvanizing line. In particular, they were tested in 15% (wt) HCl and conventional zinc plating solutions at 140° F. (60° C.). Pass-fail compression tests were run to check coating adhesion; all samples passed, and the samples were then subjected to a laboratory electroplating process at 3000 amp/ft$^2$ at a simulated 500 feet/minute line speed. The zinc plating exhibited fewer nodules than usual without the coating, and the sidewall of the edge was free of nodules.

Thus our invention may be seen as a method of protecting steel strip undergoing electrogalvanizing from the generation of zinc edge nodules comprising applying a thin band of a liquid, ultraviolet-curable coating to at least one edge of said strip, and curing said coating with radiation prior to exposing the strip to the electrogalvanizing bath. More particularly, our invention comprises the application of a band of ultraviolet-curable coating to the edges of steel strip traveling at a speed of at least 100 feet per minute, and curing said coating with ultraviolet radiation while it is traveling at such speed prior to introduction of the strip to the electrogalvanizing conditions. The coating may be any coating which is curable by ultraviolet radiation within five seconds, preferably within three seconds, and most preferably in less than one second, and is electrically non-conductive. In another sense, our invention includes the steps of cleaning steel strip as it is passed to an electrogalvanizing zone, drying said strip, applying an ultraviolet-curable coating to the edges of said strip as it moves at a rate of at least 100 feet per minute or as fast as 1200 feet per minute or more, curing said coating with ultraviolet radiation as it moves, and passing said strip into an electrogalvanizing zone where it is electrogalvanized.

We claim:

1. Method of protecting steel strip in a high speed electrogalvanizing process from generation of zinc edge nodules comprising providing a steel strip, applying as an edge band to said steel strip, while it is moving at a rate of at least 100 feet per minute, a liquid ultraviolet-curable coating, and curing said coating with ultraviolet radiation.

2. Method of claim 1 wherein said ultraviolet curable coating comprises (a) a multifunctional oligomer or prepolymer (b) a monofunctional monomer and (c) a photoinitiator.

3. Method of claim 1 wherein said coating is 0.00025 inch to 0.002 inch thick after curing.

4. Method of claim 1 wherein said coating comprises at least one oligomer and at least one reactive diluent monomer.

5. Method of claim 1 wherein said edge band is 1 mm to 7 mm wide.

6. Method of claim 1 wherein said curing is conducted in less than one second of exposure to said radiation.

7. Method of claim 1 wherein said edge band is applied to both continuous edges of said strip.

8. Method of claim 1 wherein said edge band is applied to the top, bottom, and vertical edge of said strip.

9. Method of making electrogalvanized steel strip in a high-speed electrogalvanizing line comprising, providing a steel strip in a high-speed electrogalvanizing line and, while said strip is moving at high speed in said electrogalvanizing line, (a) protecting the edge of said strip by applying a radiation-curable coating on at least one edge of said strip and curing said coating, and (b) electrogalvanizing said strip in an electrogalvanizing zone, whereby the incidence of zinc nodule formation is reduced.

10. Method of claim 9 wherein said coating comprises polyfunctional oligomer and reactive diluent monomer in a weight ratio of about 0.4:1 to about 9:1.

11. Method of claim 9 wherein said coating includes an effective amount of photoinitiator and is cured by ultraviolet radiation.

12. Method of claim 9 wherein said coating is in the form of a band on the edge of said strip, said band being from 1 to 7 mm wide.

13. Method of claim 9 wherein said coating is applied by a vacuum assisted air flow and is cured by a microwave-energized source of ultraviolet radiation.

14. Method of electrogalvanizing steel strip comprising providing a steel strip, moving said steel strip at a speed of at least 100 feet per minute through a sequence of steps comprising (a) cleaning said strip (b) coating at least one edge of said strip with a liquid coating curable by ultraviolet radiation to a non-conductive solid (c) curing said coating with ultraviolet radiation, and (d) electrogalvanizing said strip.

15. Method of claim 14 followed by trimming at least one coated edge from said strip.

16. Method of claim 14 wherein said cleaning step terminates with a drying step.

17. Method of claim 14 wherein said speed is from 100 feet per minute to 1200 feet per minute.

18. Method of claim 14 wherein said coating is effected by a vacuum-assisted air flow.

19. Method of claim 14 followed by trimming the coated edges from said strip and coiling said strip.

* * * * *